US010224663B2

(12) United States Patent
Sato

(10) Patent No.: US 10,224,663 B2
(45) Date of Patent: Mar. 5, 2019

(54) RECEPTACLE CONNECTOR

(71) Applicant: Japan Aviation Electronics Industry, Limited, Tokyo (JP)

(72) Inventor: Yukiko Sato, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/944,152

(22) Filed: Apr. 3, 2018

(65) Prior Publication Data

US 2018/0226740 A1 Aug. 9, 2018

Related U.S. Application Data

(63) Continuation of application No. PCT/JP2016/075299, filed on Aug. 30, 2016.

(30) Foreign Application Priority Data

Oct. 13, 2015 (JP) ..... 2015-202056

(51) Int. Cl.

| | |
|---|---|
| ***H01R 13/405*** | (2006.01) |
| ***H01R 13/6596*** | (2011.01) |
| ***H01R 24/78*** | (2011.01) |
| ***H01R 12/70*** | (2011.01) |
| ***H01R 12/71*** | (2011.01) |
| ***H01R 13/6594*** | (2011.01) |

(Continued)

(52) U.S. Cl.

CPC ..... *H01R 13/405* (2013.01); *H01R 12/707* (2013.01); *H01R 12/712* (2013.01); *H01R 13/6594* (2013.01); *H01R 13/6596* (2013.01); *H01R 24/78* (2013.01); *H01R 24/62* (2013.01); *H01R 43/24* (2013.01)

(58) Field of Classification Search

CPC .. H01R 13/405; H01R 12/707; H01R 12/712; H01R 13/6594

USPC ..... 439/901

See application file for complete search history.

(56) References Cited

U.S. PATENT DOCUMENTS 8,662,927 B2 * 3/2014 Yu ..... H01R 4/023 439/498
8,662,928 B1 * 3/2014 Xie ..... H01R 13/6594 439/607.35
9,214,767 B1 * 12/2015 Yu ..... H01R 13/6585

(Continued)

FOREIGN PATENT DOCUMENTS

CN 203859323 U 10/2014
JP 2004031259 A 1/2004

*Primary Examiner* — Alexander Gilman
(74) *Attorney, Agent, or Firm* — Muncy, Geissler, Olds & Lowe, P.C.

(57) ABSTRACT

A receptacle connector includes a peripheral shell with a counter connector accommodating portion formed therein and opening in a fitting direction, the peripheral shell is composed of a metal portion and a resin portion, the peripheral shell has an inner peripheral surface of tetragonal tube shape with rounded corners, the inner peripheral surface being formed by one first metal flat portion, two metal curved portions and two second metal flat portions of the metal portion and one first resin flat portion, two resin curved portions and two second resin flat portions of the resin portion, and an end surface of the one first metal flat portion situated on an opening side of the counter connector accommodating portion is exposed.

6 Claims, 9 Drawing Sheets

(51) Int. Cl.
*H01R 24/62* (2011.01)
*H01R 43/24* (2006.01)

(56) References Cited

U.S. PATENT DOCUMENTS

| | | | | |
|---|---|---|---|---|
| 9,461,425 | B2 * | 10/2016 | Tamaki | H01R 13/508 |
| 9,531,134 | B2 * | 12/2016 | Peng | H01R 13/6585 |
| 9,728,885 | B2 * | 8/2017 | Yokoyama | H01R 13/42 |
| 9,948,022 | B2 * | 4/2018 | Arai | H01R 13/6587 |
| 9,991,625 | B2 * | 6/2018 | Ozaki | H01R 13/5219 |
| 10,027,054 | B2 * | 7/2018 | Takeshita | H01R 13/5219 |
| 2015/0056858 | A1 | 2/2015 | Guo et al. | |
| 2015/0311645 | A1 * | 10/2015 | Chang | H01R 13/6594 439/607.28 |
| 2016/0013591 | A1 * | 1/2016 | Ueda | H01R 13/6581 439/607.28 |
| 2017/0214172 | A1 * | 7/2017 | Arai | H01R 13/41 |
| 2017/0346216 | A1 * | 11/2017 | Tada | H01R 12/707 |
| 2018/0226740 | A1 * | 8/2018 | Sato | H01R 12/71 |
| 2018/0287290 | A1 * | 10/2018 | Kifune | H01R 13/504 |
| 2018/0287291 | A1 * | 10/2018 | Kifune | H01R 13/504 |

* cited by examiner

RECEPTACLE CONNECTOR

BACKGROUND OF THE INVENTION

The present invention relates to a receptacle connector, particularly to a receptacle connector having a drop-in structure that includes a peripheral shell with a counter connector accommodating portion formed therein and opening in a fitting direction.

In portable electronic devices such as mobile phones and smartphones, typically, a built-in antenna is disposed along an inner surface of a housing of an electronic device in order to have improved transmission and reception of radio waves; however, when a metal surface forming a ground pattern is present near the built-in antenna, even if the metal surface is situated further inside the housing than the built-in antenna, the transmission and reception characteristics of the built-in antenna may deteriorate due to the influence of the metal surface.

To cope with it, the measures in which a planar ground pattern is not formed on a substrate disposed near a built-in antenna have been taken to reduce the influence of a metal surface on the transmission and reception characteristics.

Meanwhile, in recent years, portable electronic devices are remarkably getting thinner, and accordingly, the thickness of a receptacle connector mounted on a substrate for connection with an external device makes up a large portion of the thickness of the associated electronic device.

To cope with it, in some cases, utilized is not a receptacle connector having a structure which allows the connector to be placed and mounted on a surface of a substrate but a receptacle connector having a so-called drop-in structure which allows mounting using a cutout formed in a substrate.

For example, CN 203859323 U discloses a receptacle connector 1 having the drop-in structure as shown in FIG. 10. The receptacle connector 1 has a metal shell 3 that opens frontward, covers the periphery of a plurality of contacts 2 and serves to introduce a plug connector which is a counter connector to be fitted. A substrate 4 on which the receptacle connector 1 is mounted is formed with a cutout 5. With the front part of the metal shell 3 being inserted in the cutout 5, soldering portions 6 of the metal shell 3 are soldered to the substrate 4, while the rear ends of the contacts 2 are soldered to connection pads (not shown) of the substrate 4, whereby the receptacle connector 1 is mounted.

Owing to the use of the receptacle connector 1 having the drop-in structure as above, a thinner electronic device can be formed as compared to the case where the receptacle connector 1 is placed and mounted on the surface of the substrate 4 without provision of the cutout 5.

As shown in FIG. 11, however, a bottom surface 3A of the metal shell 3 of the receptacle connector 1 is exposed on a bottom surface 4A side of the substrate 4 through the cutout 5; therefore, when this receptacle connector 1 having the drop-in structure is used in a thin electronic device, the bottom surface 3A of the metal shell 3 is situated close to the inner surface of a housing of the electronic device and acts as a metal surface, which may degrade the transmission and reception characteristics of a built-in antenna.

Since the metal shell 3 of the receptacle connector 1 introduces a plug connector which is a counter connector, the metal shell 3 needs to have a predetermined strength in order particularly to tackle so-called "twisting" in a fitting process, and in addition, it is desired to use a grounded metal component for an opening end of the metal shell 3, which end may be contacted from the outside of the housing of the electronic device, in order to discharge static electricity.

SUMMARY OF THE INVENTION

The present invention has been made to solve the conventional problem described above and is aimed at providing a receptacle connector that can surely have a predetermined strength and mitigate the influence of electrostatic discharge while preventing the transmission and reception characteristics of a built-in antenna in an electronic device from deteriorating.

A receptacle connector according to the present invention has a drop-in structure that includes a peripheral shell with a counter connector accommodating portion formed therein and opening in a fitting direction, wherein the peripheral shell has an inner peripheral surface of tetragonal tube shape with rounded corners, the inner peripheral surface including two first flat surfaces facing each other, two second flat surfaces facing each other in a direction different from a direction in which the two first flat surfaces face each other, and four curved surfaces connecting adjacent pairs of the two first flat surfaces and the two second flat surfaces, wherein the peripheral shell is composed of a metal portion and a resin portion, wherein the metal portion includes one first metal flat portion that forms one of the two first flat surfaces, two metal curved portions that are separately continuous with opposite sides of the one first metal flat portion and form two of the four curved surfaces, two second metal flat portions that are separately continuous with the two metal curved portions and face each other, two metal bending portions that are separately continuous with the two second metal flat portions and bend outwardly of the counter connector accommodating portion, two metal edge portions that are separately continuous with the two metal bending portions and extend outwardly of the counter connector accommodating portion, and a soldering portion that is continuous with at least one of the two metal edge portions and extends in a direction crossing the one of the two first flat surfaces, wherein the resin portion includes one first resin flat portion that forms the other of the two first flat surfaces, two resin curved portions that are separately continuous with opposite sides of the one first resin flat portion and form the other two of the four curved surfaces, and two second resin flat portions that are separately continuous with the two resin curved portions and face each other, wherein the two metal bending portions and the two metal edge portions of the metal portion are covered with the resin portion, and the soldering portion of the metal portion extends to penetrate the resin portion, wherein each of inner surfaces of the two second metal flat portions is continuous with an adjacent one of inner surfaces of the two second resin flat portions in a planar manner to thereby form the two second flat surfaces, and wherein an end surface of the one first metal flat portion situated on an opening side of the counter connector accommodating portion is exposed.

The expression "an inner peripheral surface of tetragonal tube shape with rounded corners" herein refers to an inner peripheral surface in the shape of a tetragonal tube having a quadrilateral cross section orthogonal to a fitting direction, with the four corners thereof being rounded.

DETAILED DESCRIPTION OF THE INVENTION

Embodiments of the present invention are described below based on the appended drawings.

Embodiment 1

Figure 1A:
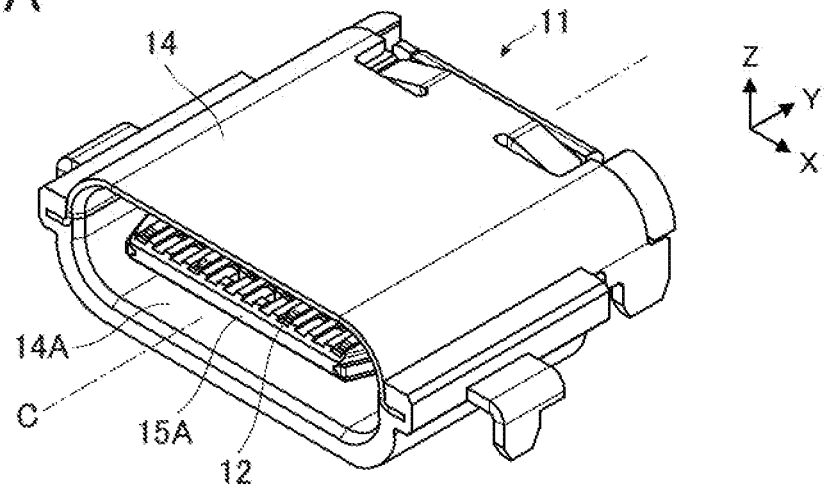
FIGS. 1A to 1C are a perspective view as seen from an obliquely upper position, a perspective view as seen from an obliquely lower position, and a front view showing a receptacle connector according to Embodiment 1 of the invention, respectively.
Figure 1B:
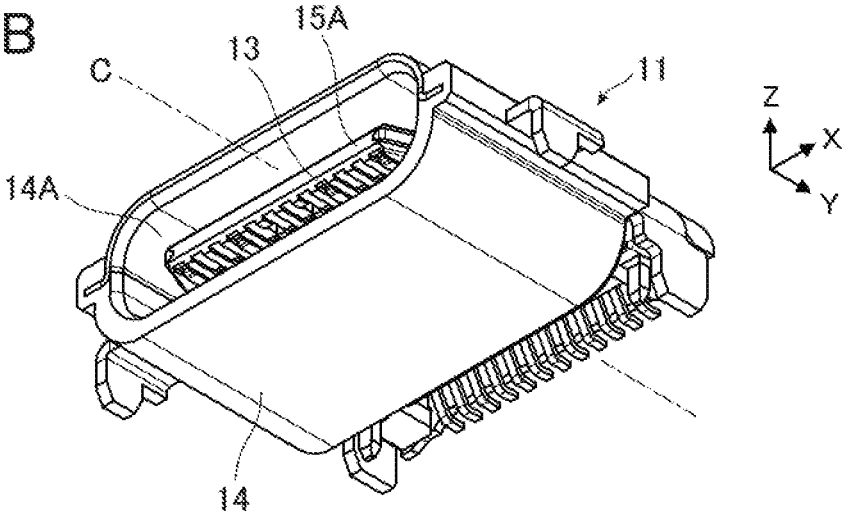
Figure 1C:
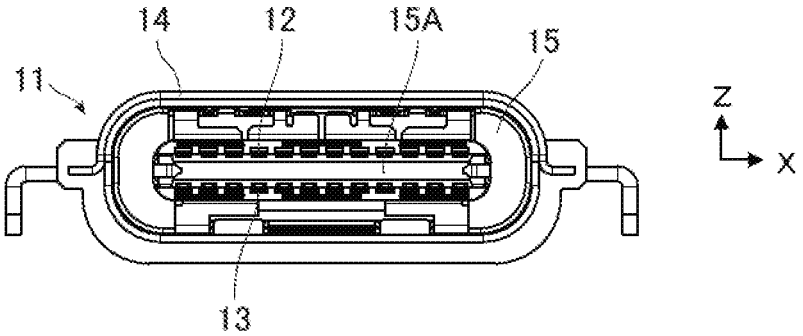

FIGS. 1A to 1C show a receptacle connector 11 according to Embodiment 1. The receptacle connector 11 is to be mounted on a substrate in a portable electronic device such as a smartphone, and includes a plurality of first contacts 12 that extend in a fitting axis C direction and are arranged in a direction perpendicular to the fitting axis C and a plurality of second contacts 13 that extend in the fitting axis C direction and are arranged parallel to the first contacts 12.

A peripheral shell 14 extending along the fitting axis C is disposed to cover the periphery of the front end portions, in the fitting axis C direction, of the first contacts 12 and second contacts 13, and a counter connector accommodating portion 14A into which a counter connector (not shown) is to be inserted is formed inside the peripheral shell 14. An insulator 15 made of insulating resin is disposed inside the counter connector accommodating portion 14A and retains the first contacts 12 and the second contacts 13. The peripheral shell 14 surrounds a peripheral portion of the insulator 15.

For convenience, the direction from front to back of the receptacle connector 11 along the fitting axis C is called "Y direction," the arrangement direction of the first contacts 12 and second contacts 13 "X direction," and the direction from the second contacts 13 toward the first contacts 12 that is perpendicular to an XY plane "Z direction."

The +Y directional end of the counter connector accommodating portion 14A of the peripheral shell 14 is blocked by the insulator 15, and the insulator 15 is provided with a tongue portion 15A extending in the −Y direction along an XY plane inside the counter connector accommodating portion 14A. The directional ends of the first contacts 12 are disposed on the surface of the tongue portion 15A on the +Z direction side, while the −Y directional ends of the second contacts 13 are disposed on the surface of the tongue portion 15A on the −Z direction side.

The −Y directional end of the counter connector accommodating portion 14A of the peripheral shell 14 opens, and a counter connector (not shown) is inserted into the counter connector accommodating portion 14A through this opening.

The +Y directional ends of the first contacts 12 and the unshown +Y directional ends of the second contacts 13 project from the peripheral shell 14 in the +Y direction.

The structure of the peripheral shell 14 is shown in FIGS. 2A to 2D. The peripheral shell 14 has a substantially tetragonal tube shape taking the fitting axis C as the central axis thereof and has an inner peripheral surface 14B surrounding the counter connector accommodating portion 14A.

Figure 2A:
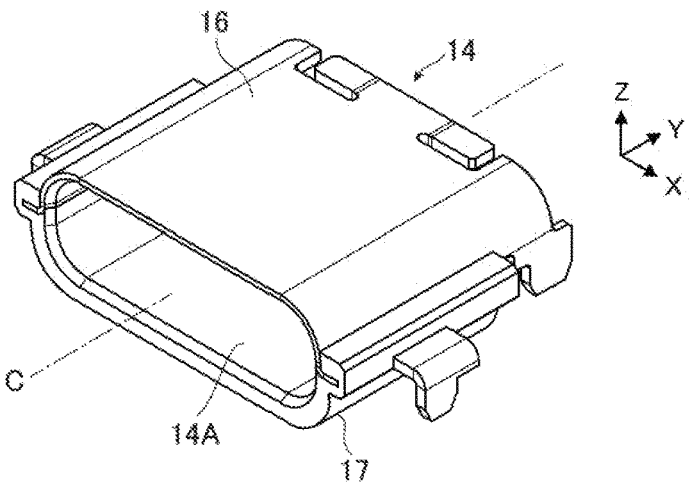
FIGS. 2A to 2D are a perspective view as seen from an obliquely upper position, a perspective view as seen from an obliquely lower position, a cross-sectional side view, and a cross-sectional front view showing a peripheral shell used in the receptacle connector of Embodiment 1, respectively.
Figure 2B:
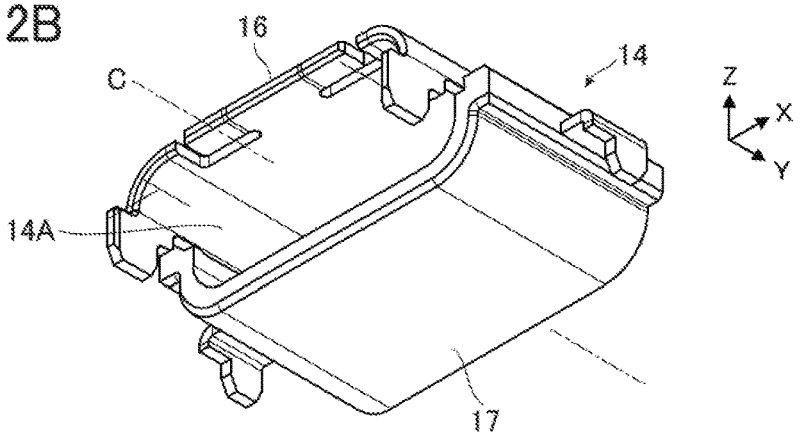
Figure 2C:
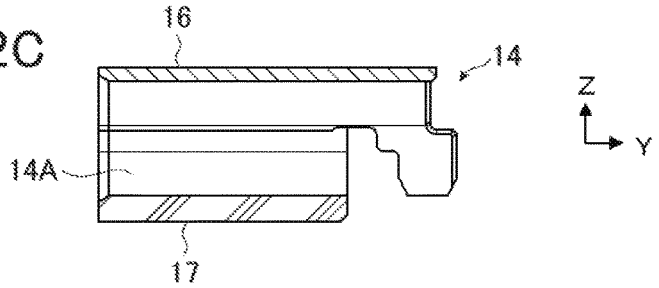
Figure 2D:
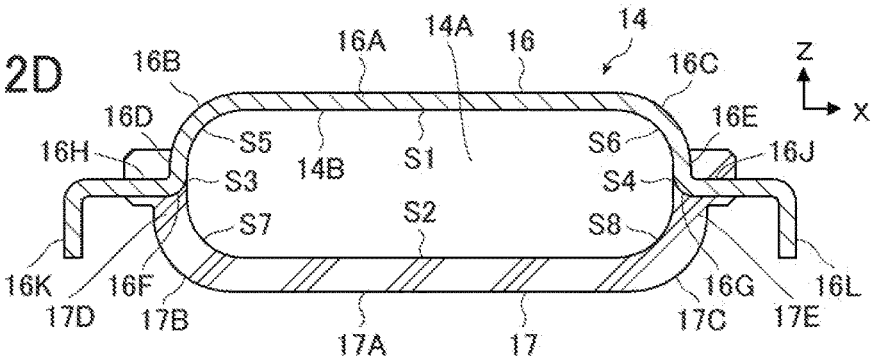

As shown in FIG. 2D, the inner peripheral surface 14B of the peripheral shell 14 is composed of two first flat surfaces S1 and S2 that extend along an XY plane in parallel to each other and face each other in the Z direction, two second flat surfaces S3 and S4 that extend along a YZ plane in parallel to each other and face each other in the X direction, and four curved surfaces S5 to S8 that connect the first flat surfaces S1 and S2 with the second flat surfaces S3 and S4, and has a tetragonal tube shape with rounded corners, in other words, a tetragonal tube shape with the four rounded corners in cross section along an XZ plane.

In the four curved surfaces S5 to S8, the curved surface S5 connects the first and second flat surfaces S1 and S3 adjacent to each other, the curved surface S6 connects the first and second flat surfaces S1 and S4 adjacent to each other, the curved surface S7 connects the first and second flat surfaces S2 and S3 adjacent to each other, and the curved surface S8 connects the first and second flat surfaces S2 and S4 adjacent to each other.

The peripheral shell 14 having the inner peripheral surface 14B as above has a structure in which a metal portion 16 made of metal and disposed on the +Z direction side and a resin portion 17 made of insulating resin and disposed on the −Z direction side are integrally joined together.

The metal portion 16 includes a first metal flat portion 16A in a flat plate shape that extends along an XY plane, two metal curved portions 169 and 16C that are respectively continuous with the −X and +X directional ends of the first metal flat portion 16A and curve toward the −Z direction, and two second metal flat portions 16D and 16E that are respectively continuous with the −Z directional ends of the metal curved portions 169 and 16C and extend in the −Z direction so as to face each other in the X direction.

The metal portion 16 further includes two metal bending portions 16F and 16G that are respectively continuous with the −Z directional ends of the second metal flat portions 16D and 16E and bend outwardly of the counter connector accommodating portion 14A, i.e., toward the −X and +X directions, two metal edge portions 16H and 16J that are respectively continuous with the metal bending portions 16F and 16G and extend outwardly of the counter connector accommodating portion 14A, and two soldering portions 16K and 16L that are respectively continuous with the metal edge portions 16H and 16J and extend further outwardly of the counter connector accommodating portion 14A.

The resin portion 17 includes a first resin flat portion 17A in a flat plate shape that extends along an XY plane, two resin curved portions 17B and 17C that are respectively continuous with the −X and +X directional ends of the first resin flat portion 17A and curve toward the +Z direction, and two second resin flat portions 17D and 17E that are respectively continuous with the +Z directional ends of the resin curved portions 17B and 17C and extend in the +Z direction so as to face each other in the X direction.

The first flat surface S1 of the inner peripheral surface 14B of the peripheral shell 14 is formed from the inner surface, i.e., the −Z direction-side surface of the first metal flat portion 16A of the metal portion 16, and the curved surfaces S5 and S6 of the inner peripheral surface 14B of the peripheral shell 14 are respectively formed from the inner surfaces of the metal curved portions 16B and 16C of the metal portion 16.

Likewise, the first flat surface S2 of the inner peripheral surface 14B of the peripheral shell 14 is formed from the inner surface, i.e., the +Z direction-side surface of the first resin flat portion 17A of the resin portion 17, and the curved surfaces S7 and S8 of the inner peripheral surface 14B of the peripheral shell 14 are respectively formed from the inner surfaces of the resin curved portions 17B and 17C of the resin portion 17.

The inner surface, i.e., the +X direction-side surface of the second metal flat portion 16D of the metal portion 16 is smoothly continuous with the inner surface, i.e., the +X direction-side surface of the second resin flat portion 17D of the resin portion 17 in the same YZ plane, whereby the second flat surface S3 of the inner peripheral surface 14B of the peripheral shell 14 is formed.

Likewise, the inner surface, i.e., the −X direction-side surface of the second metal flat portion 16E of the metal portion 16 is smoothly continuous with the inner surface, i.e., the −X direction-side surface of the second resin flat portion 17E of the resin portion 17 in the same YZ plane, whereby the second flat surface S4 of the inner peripheral surface 14B of the peripheral shell 14 is formed.

The two metal bending portions 16F and 16G and two metal edge portions 16H and 16J of the metal portion 16 are covered with the resin portion 17. The soldering portion 16K continuous with the metal edge portion 16H penetrates the resin portion 17 to project in the −X direction and then bends at a right angle to extend in the −Z direction away from the first metal flat portion 16A, while the soldering portion 16L continuous with the metal edge portion 16J penetrates the resin portion 17 to project in the +X direction and then bends at a right angle to extend in the −Z direction away from the first metal flat portion 16A.

The end surface of the first metal flat portion 16A situated at the −Y directional end of the peripheral shell 14 on the opening side of the counter connector accommodating portion 14A is exposed without being covered with the resin portion 17. Likewise, the end surfaces of the two metal curved portions 16B and 16C, those of the two second metal flat portions 16D and 16E and those of the two metal edge portions 16H and 16J, all of which are situated at the −Y directional end of the peripheral shell 14, are exposed without being covered with the resin portion 17.

Thus, the peripheral shell 14 has a structure in which the metal portion 16 and the resin portion 17 are integrally joined together. Specifically, the inner surface of the second metal flat portion 16D of the metal portion 16 is smoothly continuous with the inner surface of the second resin flat portion 17D of the resin portion 17 in the same plane, whereby the second flat surface S3 of the inner peripheral surface 14B of the peripheral shell 14 is formed, while the inner surface of the second metal flat portion 16E of the metal portion 16 is smoothly continuous with the inner surface of the second resin flat portion 17E of the resin portion 17 in the same plane, whereby the second flat surface S4 of the inner peripheral surface 14E of the peripheral shell 14 is formed. Owing to this configuration, it is possible to smoothly introduce a counter connector (not shown) for insertion into the counter connector accommodating portion 14A.

Figure 3:
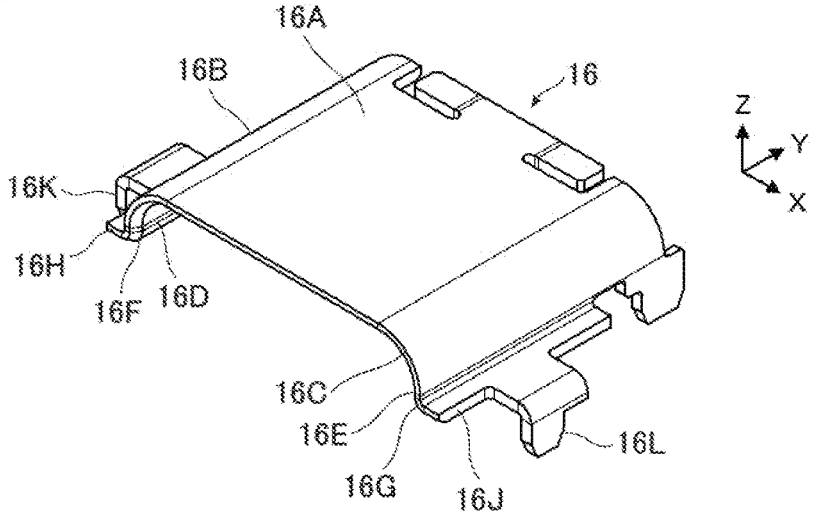
FIG. 3 is a perspective view showing a metal portion of the peripheral shell used in Embodiment 1.
Figure 4:
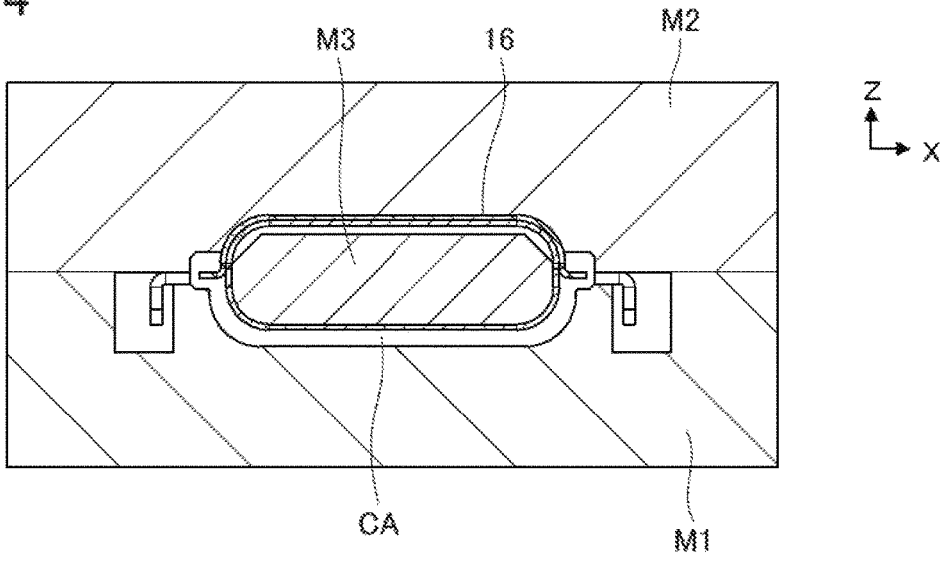
FIG. 4 is a cross-sectional view showing the state where the metal portion is disposed in a mold used to form a resin portion of the peripheral shell.

The peripheral shell 14 can be produced by, for instance, cutting and bending a metal sheet to form the metal portion 16 as shown in FIG. 3, placing the formed metal portion 16 in the molds M1 and M2 as shown in FIG. 4, and then carrying out insert molding. After the metal portion 16 is placed in the molds M1 and M2 and a mold slide component M3 is placed so as to come in contact with the metal portion 16, the molds M1 and M2 are clamped, and molten resin is injected into a cavity CA to form the resin portion 17 integrally with the metal portion 16, thereby obtaining the peripheral shell 14.

In this insert molding, the portions where the metal portion 16 and the resin portion 17 are integrally joined to each other are situated at the second flat surfaces S3 and S4, and accordingly, the mold slide component M3 can come in contact at its flat portions with the second metal flat portions 16D and 16E of the metal portion 16 as shown in FIG. 4, which makes it possible to facilitate formation of the second flat surfaces S3 and S4 where the inner surfaces of the second metal flat portions 16D and 16E of the metal portion 16 are smoothly continuous with the inner surfaces of the second resin flat portions 17D and 17E of the resin portion 17 in the same planes, respectively.

If, say, the portions where the metal portion 16 and the resin portion 17 are integrally joined to each other are situated at the curved surfaces S5 to S8, the mold slide component M3 is to come in contact at its curved portions with the metal curved portions 16B and 16C, and radii of curvature of the facing curved portions need to be precisely identical to each other; otherwise, molten resin is easily leaked, which hampers formation of smoothly continuous curved portions.

The receptacle connector 11 having the peripheral shell 14 as above is a connector with a drop-in structure, and as shown in FIGS. 5A to 5D, is mounted on the substrate 18 with the resin portion 17 of the peripheral shell 14, being inserted in a cutout 19 formed in the substrate 18. The soldering portions 16K and 16L of the metal portion 16 of the peripheral shell 14 are separately inserted in and soldered to through-holes 18A of the substrate 18, while the +Y directional ends of the first contacts 12 and second contacts 13 are soldered to connection pads (not shown) on an upper surface 18B, the surface of the substrate 18 on the +Z direction side. At this time, the metal portion 16 of the peripheral shell 14 is electrically grounded via the soldering portions 16K and 16L soldered to the through-holes 18A of the substrate 18.

Figure 5A:
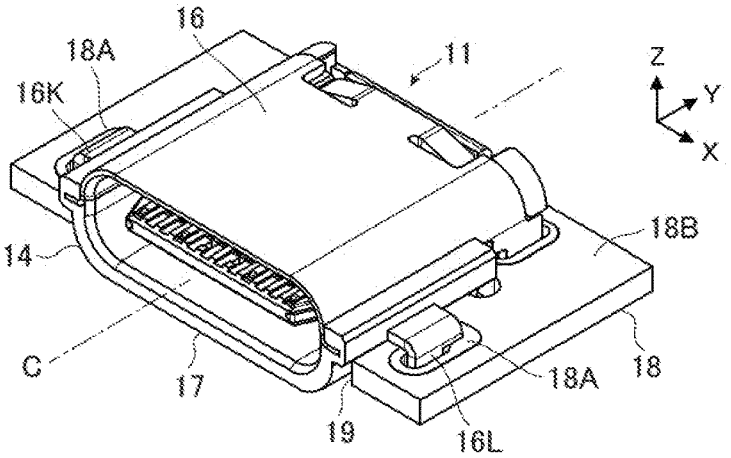
FIGS. 5A to 5D are a perspective view as seen from an obliquely upper position, a perspective view as seen from an obliquely lower position, a plan view, and a front view showing the receptacle connector of Embodiment 1 that is mounted on a substrate, respectively.
Figure 5B:
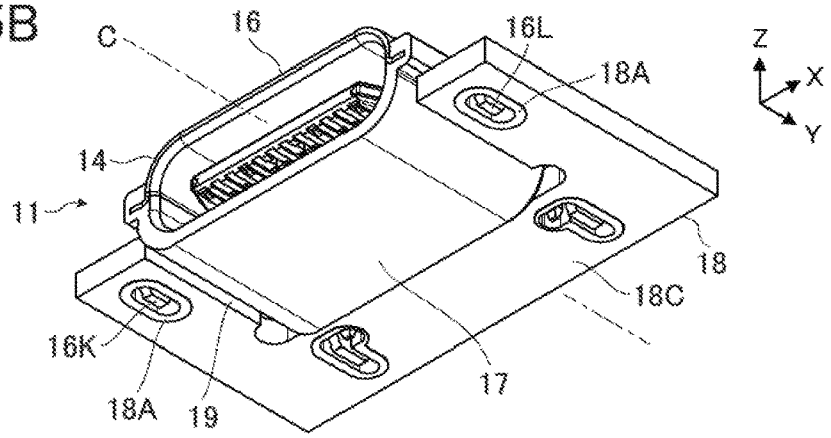
Figure 5C:
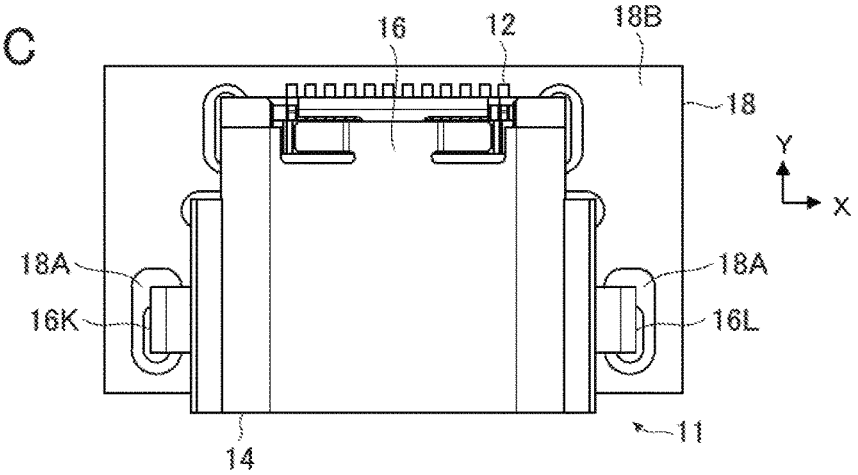
Figure 5D:
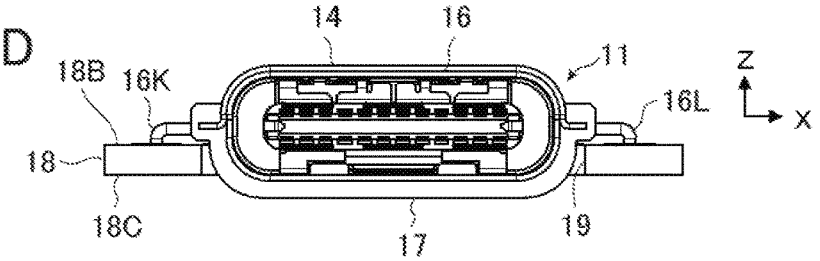

As shown in FIG. 5D, the resin portion 17 of the peripheral shell 14 inserted in the cutout 19 of the substrate 18 protrudes in the −Z direction from a bottom surface 18C of the substrate 18.

Owing to the use of the receptacle connector 11 having the drop-in structure, installation in a thin electronic device becomes possible.

The substrate on which the receptacle connector 11 is mounted is installed in a thin electronic device with the bottom surface 18C facing in the −Z direction being situated close to an inner surface of a housing of the electronic device. At this time, since the resin portion 17 of the peripheral shell 14 projecting in the −Z direction from the bottom surface 18C of the substrate 18 is made of insulating resin, even When a built-in antenna is disposed along the inner surface of the housing of the electronic device and the peripheral shell 14 of the receptacle connector 11 comes close to the built-in antenna through the cutout 19, the receptacle connector 11 can be prevented from adversely affecting the transmission and reception characteristics of the built-in antenna. Thus, the thin electronic device can be obtained without deterioration in the transmission and reception characteristics of the built-in antenna.

The peripheral shell 14 of the receptacle connector 11 is not made solely of resin but has a structure in which the metal portion 16 and the resin portion 17 are integrally joined together, and therefore, the receptacle connector 11 can surely have a sufficient strength for tackling so-called "twisting" in a fitting process with a counter connector.

While the end surfaces of the first metal flat portion 16A, metal curved portions 16B and 16C, second metal flat portions 16D and 16E and metal edge portions 16H and 16J of the metal portion 16 on the opening side of the counter connector accommodating portion 14A are exposed, the metal portion 16 is electrically grounded via the soldering portions 16K and 16L soldered to the through-holes 18A of the substrate 18, which makes it possible to mitigate the influence of electrostatic discharge.

Embodiment 2

Figure 6A:
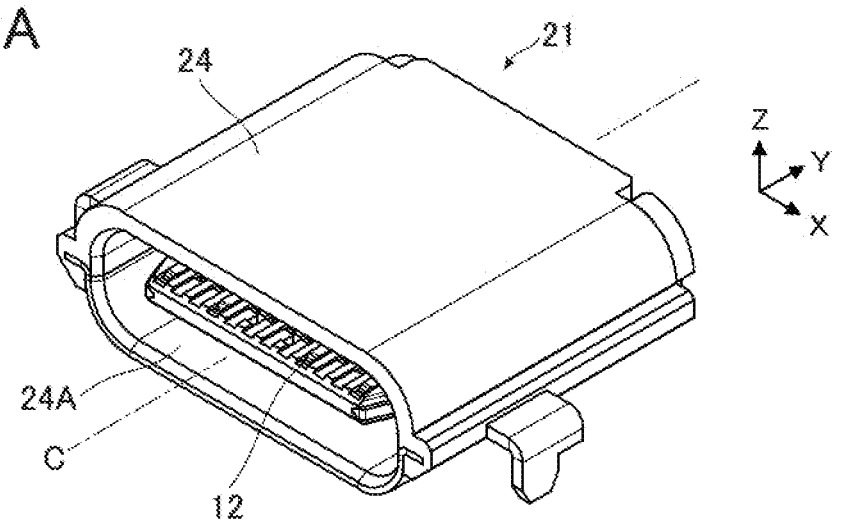
FIGS. 6A to 6C are a perspective view as seen from an obliquely upper position, a perspective view as seen from an obliquely lower position, and a front view showing a receptacle connector according to Embodiment 2, respectively.
Figure 6B:
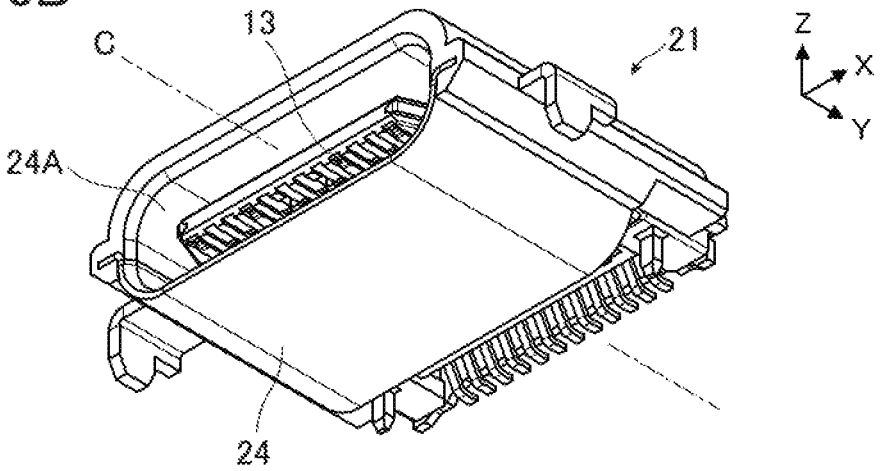
Figure 6C:
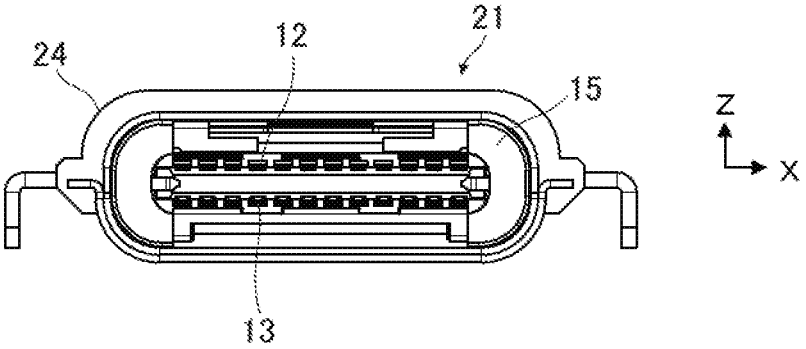

FIGS. 6A to 6C show a receptacle connector 21 according to Embodiment 2. The receptacle connector 21 is configured to have a peripheral shell 24 in place of the peripheral shell 14 in the receptacle connector 11 of Embodiment 1, and the other components are the same as those of the receptacle connector 11.

Specifically, the peripheral shell 24 extending along the fitting axis C is disposed to cover the periphery of the front end portions, in the fitting axis C direction, of the first contacts 12 and second contacts 13, and a counter connector accommodating portion 24A into which a counter connector (not shown) is to be inserted is formed inside the peripheral shell 24. The +Y directional end of the counter connector accommodating portion 24A is blocked by the insulator 15, and the −Y directional end of the counter connector accommodating portion 24A opens for insertion of a counter connector (not shown).

The structure of the peripheral shell 24 is shown in FIGS. 7A to 7D. The peripheral shell 24 has a substantially tetragonal tube shape taking the fitting axis C as the central axis and has an inner peripheral surface 24B surrounding the counter connector accommodating portion 24A.

Figure 7A:
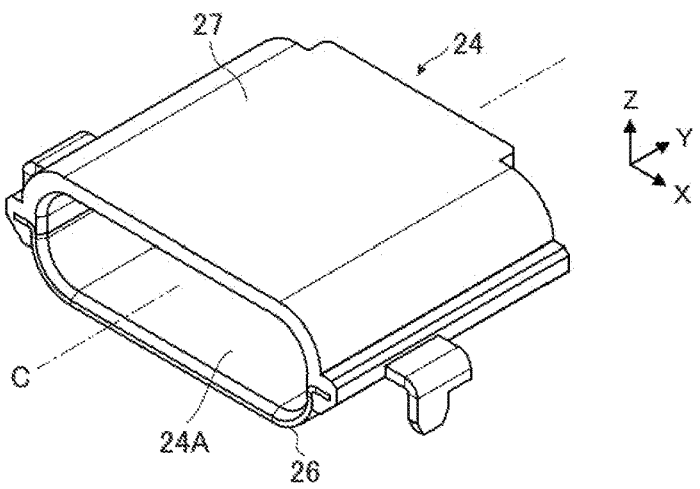
FIGS. 7A to 7D are a perspective view as seen from an obliquely upper position, a perspective view as seen from an obliquely lower position, a cross-sectional side view, and a cross-sectional front view showing a peripheral shell used in the receptacle connector of Embodiment 2, respectively.
Figure 7B:
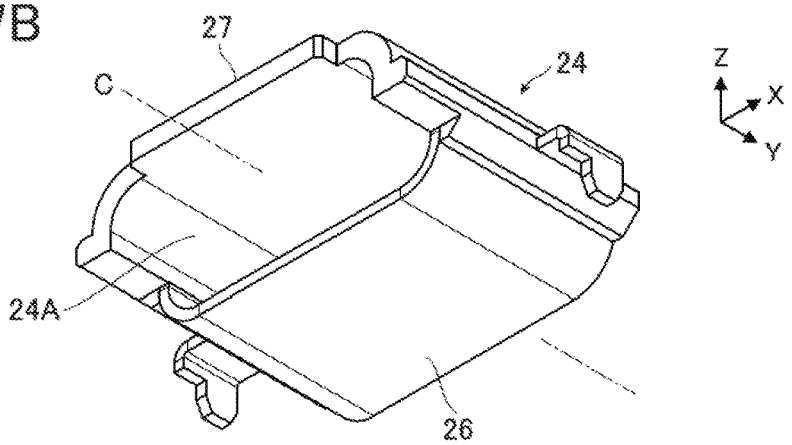
Figure 7C:
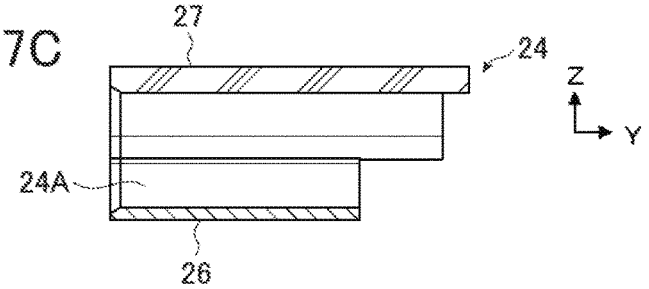
Figure 7D:
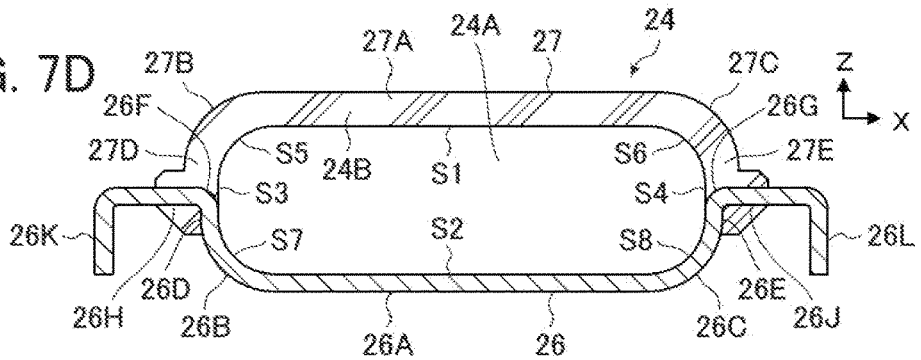

The inner peripheral surface 24B of the peripheral shell 24 is the same as the inner peripheral surface 14B of the peripheral shell 14 in Embodiment 1 shown in FIG. 2D. Specifically, as shown in FIG. 7D, the inner peripheral surface 24B is composed of the two first flat surfaces S1 and S2 that extend along an XY plane in parallel to each other and face each other in the Z direction, the two second flat surfaces S3 and S4 that extend along a YZ plane in parallel to each other and face each other in the X direction, and the four curved surfaces S5 to S8 that connect the first flat surfaces S1 and S2 with the second flat surfaces S3 and S4, and has a tetragonal tube shape with rounded corners, in other words, a tetragonal tube shape with the four rounded corners in cross section along an XZ plane The peripheral shell 24 having the inner peripheral surface 24B as above has a structure in which a metal portion 26 made of metal and disposed on the −Z direction side and a resin portion 27 made of insulating resin and disposed on the +Z direction side are integrally joined together.

The metal portion 26 includes a first metal flat portion 26A in a flat plate shape that extends along an XY plane, two metal curved portions 26B and 260 that are respectively continuous with the −X and +X directional ends of the first metal flat portion 26A and curve toward the +Z direction, and two second metal flat portions 263 and 26E that axe respectively continuous with the +Z directional ends of the metal curved portions 26B and 26C and extend in the +Z direction so as to face each other in the X direction.

The metal portion 26 further includes two metal bending portions 26F and 26G that are respectively continuous with the +Z directional ends of the second metal flat portions 26D and 26E and bend outwardly of the counter connector accommodating portion 24A, i.e., toward the −X and +X directions, two metal edge portions 26H and 26J that are respectively continuous with the metal bending portions 26F and 26G and extend outwardly of the counter connector accommodating portion 24A, and two soldering portions 26K and 26L that are respectively continuous with the metal edge portions 26H and 26J and extend further outwardly of the counter connector accommodating portion 24A.

The resin portion 27 includes a first resin flat portion 27A in a flat plate shape that extends along an XY plane, two resin curved portions 27B and 27C that are respectively continuous with the −X and +X directional ends of the first resin flat portion 27A and curve toward the −Z direction, and two second resin flat portions 27D and 27E that are respectively continuous with the −Z directional ends of the resin curved portions 27B and 27C and extend in the −Z direction so as to face each other in the X direction.

The first flat surface S1 of the inner peripheral surface 24B of the peripheral shell 24 is formed from the inner surface, i.e., the −Z direction-side surface of the first resin flat portion 27A of the resin portion 27, and the curved surfaces S5 and S6 of the inner peripheral surface 24B of the peripheral shell 24 are respectively formed from the inner surfaces of the resin curved portions 27B and 27C of the resin portion 27.

Likewise, the first flat surface S2 of the inner peripheral surface 24B of the peripheral shell 24 is formed from the inner surface, i.e., the +Z direction-side surface of the first metal flat portion 26A of the metal portion 26, and the curved surfaces S7 and S8 of the inner peripheral surface 24B of the peripheral shell 24 are respectively formed from the inner surfaces of the metal curved portions 26B and 26C of the metal portion 26.

The inner surface, i.e., the +X direction-side surface of the second metal flat portion 26D of the metal portion 26 is smoothly continuous with the inner surface, i.e., the +X direction-side surface of the second resin flat portion 27D of the resin portion 27 in the same YZ plane, whereby the second flat surface S3 of the inner peripheral surface 24B of the peripheral shell 24 is formed.

Likewise, the inner surface, i.e., the −X direction-side surface of the second metal flat portion 26E of the metal portion 26 is smoothly continuous with the inner surface, i.e., the −X direction-side surface of the second resin flat portion 27E of the resin portion 27 in the same YZ plane, whereby the second flat surface S4 of the inner peripheral surface 24B of the peripheral shell 24 is formed.

The two metal bending portions 26F and 26G and two metal edge portions 26H and 26J of the metal portion 26 are covered with the resin portion 27. The soldering portion 26K continuous with the metal edge portion 26H penetrates the resin portion 27 to project in the −X direction and then bends at a right angle to extend in the −Z direction, while the soldering portion 26L continuous with the metal edge portion 26J penetrates the resin portion 27 to project in the +X direction and then bends at a right angle to extend in the −Z direction.

The end surface of the first metal flat portion 26A situated at the −Y directional end of the peripheral shell 24 on the opening side of the counter connector accommodating portion 24A is exposed without being covered with the resin portion 27. Likewise, the end surfaces of the two metal curved portions 26B and 26C, those of the two second metal flat portions 26D and 26E and those of the two metal edge portions 26H and 26J, all of which are situated at the −Y directional end of the peripheral shell 24, are exposed without being covered with the resin portion 27.

Thus, the peripheral shell 24 has a structure in which the metal portion 26 and the resin portion 27 are integrally joined together. Specifically, the inner surface of the second metal flat portion 26D of the metal portion 26 is smoothly continuous with the inner surface of the second resin flat portion 27D of the resin portion 27 in the same plane, whereby the second flat surface S3 of the inner peripheral surface 24B of the peripheral shell 24 is formed, while the inner surface of the second metal flat portion 26E of the metal portion 26 is smoothly continuous with the inner surface of the second resin flat portion 27E of the resin portion 27 in the same plane, whereby the second flat surface S4 of the inner peripheral surface 24B of the peripheral shell 24 is formed. Owing to this configuration, it is possible to smoothly introduce a counter connector (not shown) for insertion into the counter connector accommodating portion 24A.

Figure 8:
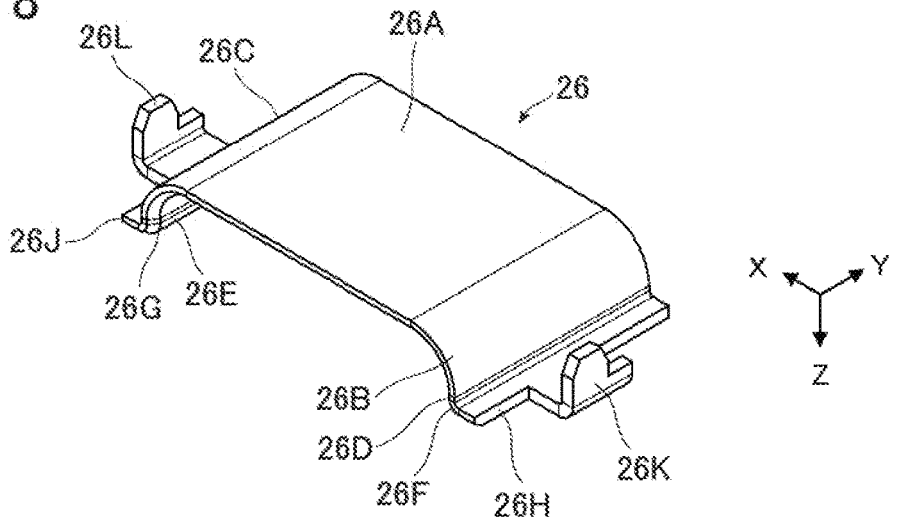
FIG. 8 is a perspective view showing a metal portion of the peripheral shell used in Embodiment 2.

The peripheral shell 24 can be produced by, for instance, cutting and bending a metal sheet to form the metal portion 26 as shown in FIG. 8, placing the formed metal portion 26 in the molds M1 and M2 as shown in FIG. 4, and then carrying out insert molding.

The receptacle connector 21 having the peripheral shell 24 as above is a connector with a drop-in structure, and as shown in FIGS. 9A to 9D, is mounted on the substrate 28 with the metal portion 26 of the peripheral shell 24 being inserted in a cutout 29 formed in the substrate 28. The soldering portions 26K and 26L of the metal portion 26 of the peripheral shell 24 are separately inserted in and soldered to through-holes 28A of the substrate 28, while the +Y directional ends of the first contacts 12 and second contacts 13 are soldered to connection pads (not shown) on an upper surface 28B, i.e., the surface of the substrate 28 on the +Z direction side. At this time, the metal portion 26 of the peripheral shell 24 is electrically grounded via the soldering portions 26K and 26L soldered to the through-holes 28A of the substrate 28.

Figure 9A:
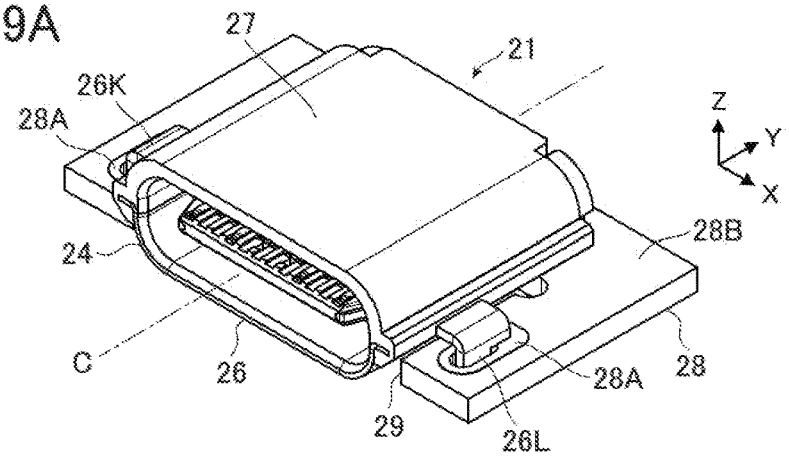
FIGS. 9A to 9D are a perspective view as seen from an obliquely upper position, a perspective view as seen from an obliquely lower position, a plan view, and a front view showing the receptacle connector of Embodiment 2 that is mounted on a substrate, respectively.
Figure 9B:
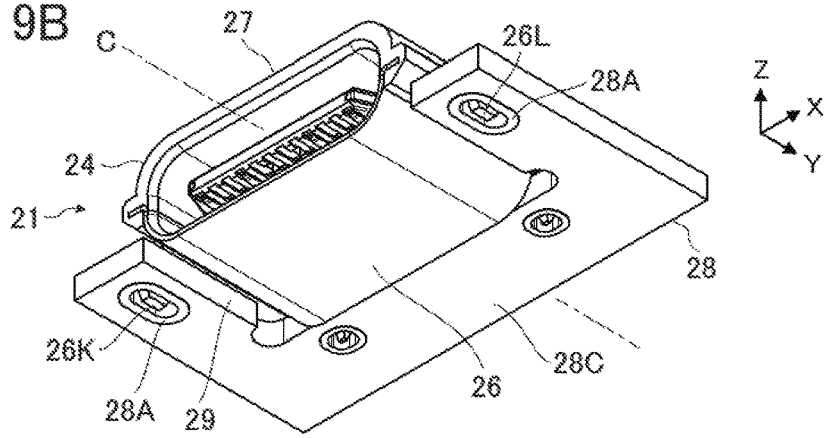
Figure 9C:
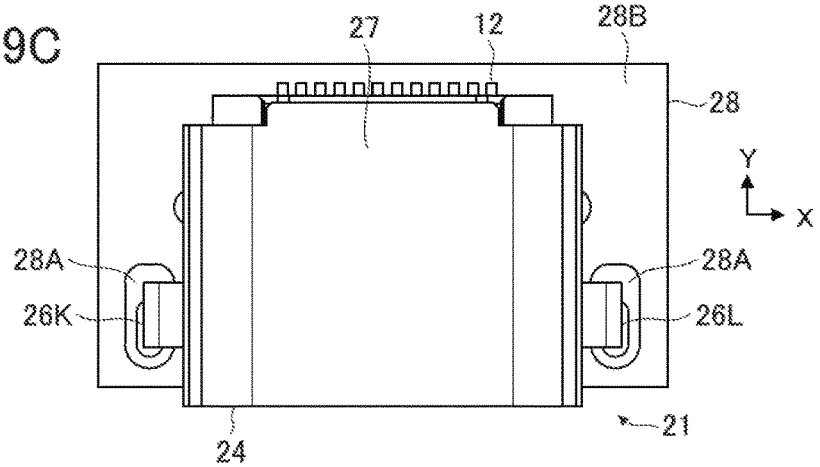
Figure 9D:
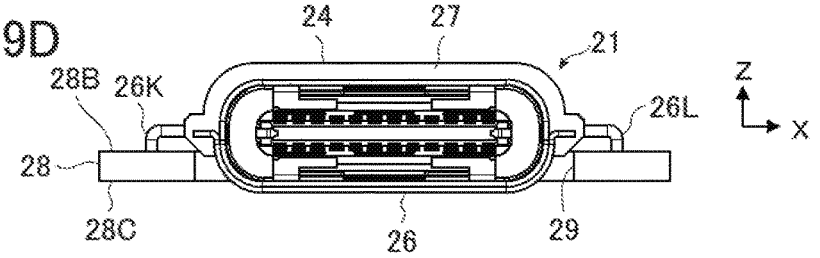
Figure 10:
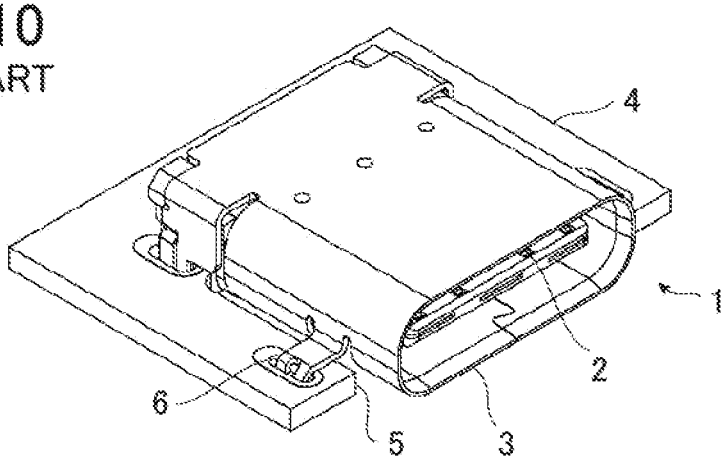
FIG. 10 PRIOR ART
FIG. 10 is a perspective view showing a conventional receptacle connector that is mounted on a substrate.
Figure 11:
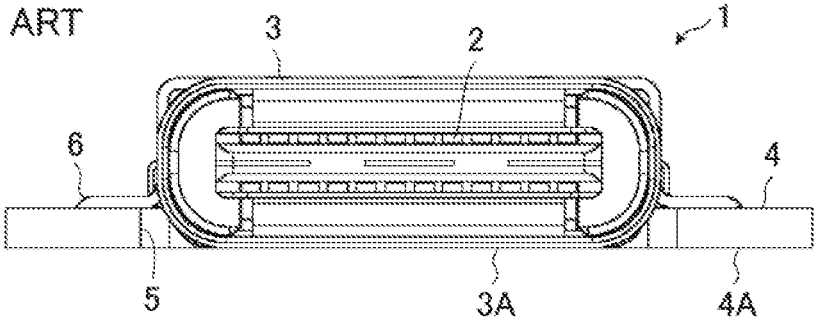
FIG. 11 PRIOR ART
FIG. 11 is a front view showing the conventional receptacle connector that is mounted on the substrate.

As shown in FIG. 9D, the metal portion 26 of the peripheral shell 24 inserted in the cutout 29 of the substrate 28 protrudes in the −Z direction from a bottom surface 28C of the substrate 28.

Owing to the use of the receptacle connector 21 having the drop-in structure, installation in a thin electronic device becomes possible.

In the receptacle connector 21 according to Embodiment 2, the metal portion 26 of the peripheral shell 24 is exposed on the bottom surface 28C side of the substrate 28 through the cutout 29 of the substrate 28, and the resin portion 27 of the peripheral shell 24 is disposed on the upper surface 28B side of the substrate; therefore, when the substrate 28 on which the receptacle connector 21 is mounted is installed in a housing of an electronic device such that the upper surface 283 of the substrate 28 faces a built-in antenna in the electronic device, particularly the transmission and reception characteristics of the built-in antenna can be prevented from deteriorating. In other words, even when the peripheral shell 24 of the receptacle connector 21 comes close to the built-in antenna on the upper surface 28B side of the substrate 28, what comes closest to the built-in antenna is not the metal portion 26 but the resin portion 27, and accordingly, the transmission and reception characteristics of the built-in antenna can be prevented from deteriorating.

As with the receptacle connector 11 of Embodiment 1, also in the receptacle connector 21 according to Embodiment 2, the peripheral shell 24 is not made solely of resin but has a structure in which the metal portion 26 and the resin portion 27 are integrally joined together. Therefore, the receptacle connector 21 can surely have a sufficient strength for tackling so-called "twisting" in a fitting process with a counter connector.

While the end surfaces of the first metal flat portion 26A, metal curved portions 26B and 26C, second metal flat portions 26D and 26E and metal edge portions 26H and 26J of the metal portion 26 on the opening side of the counter connector accommodating portion 24A are exposed, the metal portion 26 is electrically grounded via the soldering portions 26K and 26L soldered to the through-holes 28A of the substrate 28, which makes it possible to mitigate the influence of electrostatic discharge.

While, in Embodiments 1 and 2 described above, each of the inner peripheral surface 14B of the peripheral shell 14 and the inner peripheral surface 24B of the peripheral shell 24 has the two second flat surfaces S3 and S4 that lie parallel to each other and face each other in the X direction, the invention is not limited thereto, and the second flat surfaces S3 and S4 may be inclined such that they extend in directions crossing each other. For example, the inner peripheral surface may have a trapezoid-like shape with rounded corners when viewed in the Y direction along the fitting axis C.

In Embodiment 1 above, the soldering portions 16K and 16L of the metal portion 16 of the peripheral shell 14 extend in the −Z direction perpendicular to the first flat surfaces S1 and S2 of the inner peripheral surface 14B of the peripheral shell 14, and also in Embodiment 2, the soldering portions 26K and 26L of the metal portion 26 of the peripheral shell 24 extend in the −Z direction perpendicular to the first flat surfaces S1 and S2 of the inner peripheral surface 246 of the peripheral shell 24; however, the invention is not limited thereto, and it suffices if the soldering portions 16K, 16L, 26K and 26L extend in a direction crossing the first flat surfaces S1 and S2.

What is claimed is:

1. A receptacle connector having a drop-in structure that includes a peripheral shell with a counter connector accommodating portion formed therein and opening in a fitting direction, wherein the peripheral shell has an inner peripheral surface of tetragonal tube shape with rounded corners, the inner peripheral surface including two first flat surfaces facing each other, two second flat surfaces facing each other in a direction different from a direction in which the two first flat surfaces face each other, and four curved surfaces connecting adjacent pairs of the two first flat surfaces and the two second flat surfaces, wherein the peripheral shell is composed of a metal portion and a resin portion, wherein the metal portion includes one first metal flat portion that forms one of the two first flat surfaces, two metal curved portions that are separately continuous with opposite sides of the one first metal flat portion and form two of the four curved surfaces, two second metal flat portions that are separately continuous with the two metal curved portions and face each other, two metal bending portions that are separately continuous with the two second metal flat portions and bend outwardly of the counter connector accommodating portion, two metal edge portions that are separately continuous with the two metal bending portions and extend outwardly of the counter connector accommodating portion, and a soldering portion that is continuous with at least one of the two metal edge portions and extends in a direction crossing the one of the two first flat surfaces, wherein the resin portion includes one first resin flat portion that forms the other of the two first flat surfaces, two resin curved portions that are separately continuous with opposite sides of the one first resin flat portion and form the other two of the four curved surfaces, and two second resin flat portions that are separately continuous with the two resin curved portions and face each other, wherein the two metal bending portions and the two metal edge portions of the metal portion are covered with the resin portion, and the soldering portion of the metal portion extends to penetrate the resin portion, wherein each of inner surfaces of the two second metal flat portions is continuous with an adjacent one of inner surfaces of the two second resin flat portions in a planar manner to thereby form the two second flat surfaces, and wherein an end surface of the one first metal flat portion situated on an opening side of the counter connector accommodating portion is exposed.

2. The receptacle connector according to claim 1, wherein the soldering portion of the metal portion extends in a direction away from the one first metal flat portion.

3. The receptacle connector according to claim 1, wherein the two first flat surfaces are parallel to each other, and the two second flat surfaces are also parallel to each other.

4. The receptacle connector according to claim 1, wherein end surfaces of the two metal curved portions, end surfaces of the two second metal flat portions, and end surfaces of the two metal edge portions, all of which end surfaces are situated on the opening side of the counter connector accommodating portion, are exposed.

5. The receptacle connector according to claim 1, wherein the metal portion includes two soldering portions that are separately continuous with the two metal edge portions and extend in the direction crossing the one of the two first flat surfaces.

6. A receptacle connector having a drop-in structure that includes a peripheral shell with a counter connector accommodating portion formed therein and opening in a fitting direction, wherein the peripheral shell has an inner peripheral surface of tetragonal tube shape with rounded corners, the inner peripheral surface including two first flat surfaces facing each other, two second flat surfaces facing each other in a direction different from a direction in which the two first flat surfaces face each other, and four curved surfaces connecting adjacent pairs of the two first flat surfaces and the two second flat surfaces, wherein the peripheral shell is composed of a metal portion and a resin portion, wherein the metal portion includes one first metal flat portion that forms one of the two first flat surfaces, two metal curved portions that are separately continuous with opposite sides of the one first metal flat portion and form two of the four curved surfaces, two second metal flat portions that are separately continuous with the two metal curved portions and face each other, two metal bending portions that are separately continuous with the two second metal flat portions and bend outwardly of the counter connector accommodating portion, two metal edge portions that are separately continuous with the two metal bending portions and extend outwardly of the counter connector accommodating portion, and a soldering portion that is continuous with at least one of the two metal edge portions and extends in a direction crossing the one of the two first flat surfaces, wherein the resin portion includes one first resin flat portion that forms the other of the two first flat surfaces, two resin curved portions that are separately continuous with opposite sides of the one first resin flat portion and form the other two of the four curved surfaces, and two second resin flat portions that are separately continuous with the two resin curved portions and face each other, wherein the two metal bending portions and the two metal edge portions of the metal portion are covered with the resin portion, and the soldering portion of the metal portion extends to penetrate the resin portion, wherein each of inner surfaces of the two second metal flat portions is continuous with an adjacent one of inner surfaces of the two second resin flat portions in a planar manner to thereby form the two second flat surfaces, wherein an end surface of the one first metal flat portion, end surfaces of the two metal curved portions, end surfaces of the two second metal flat portions, and end surfaces of the two metal edge portions, all of which end surfaces are situated on an opening side of the counter connector accommodating portion, are exposed, wherein the soldering portion of the metal portion extends in a direction away from the one first metal flat portion, and wherein the two first flat surfaces are parallel to each other, and the two second flat surfaces are also parallel to each other.

* * * * *